US006473044B2

(12) United States Patent
Manteuffel et al.

(10) Patent No.: US 6,473,044 B2
(45) Date of Patent: Oct. 29, 2002

(54) INTEGRATED ANTENNA FOR MOBILE TELEPHONES

(75) Inventors: Dirk Manteuffel, Moers (DE); Achim Bahr, Viersen (DE); José Marie Baro, Taverny (FR)

(73) Assignee: Alcatel, Paris (FR)

( * ) Notice: Subject to any disclaimer, the term of this patent is extended or adjusted under 35 U.S.C. 154(b) by 0 days.

(21) Appl. No.: 09/849,355

(22) Filed: May 7, 2001

(65) Prior Publication Data

US 2002/0005809 A1 Jan. 17, 2002

(30) Foreign Application Priority Data

May 8, 2000 (DE) ..... 100 22 107

(51) Int. Cl.[7] ..... H01Q 1/24
(52) U.S. Cl. ..... 343/702; 343/700 MS
(58) Field of Search ..... 343/702, 700 MS, 343/795, 829, 830, 846; H01Q 1/38, 1/24

(56) References Cited

U.S. PATENT DOCUMENTS 6,304,219 B1 * 10/2001 Rothe ..... 343/700 MS

* cited by examiner

*Primary Examiner*—Michael C. Wimer
(74) *Attorney, Agent, or Firm*—Sughrue Mion, PLLC

(57) ABSTRACT

An Integrated Antenna for Mobile Telephones A flat antenna arrangement (plate antenna arrangement, patch antenna arrangement) with an earth plate (2) and a radiator (3) which is arranged at a distance from and substantially in parallel to the earth plate (2) and at one of its end zones is conductively connected to the earth plate), wherein at a first (lower) resonant frequency of the antenna arrangement (1) a voltage minimum occurs at the connection point of the radiator to the earth plate (2) and a first voltage maximum occurs in the region of the other end (free end) of the radiator, and at a further, higher resonant frequency, a voltage minimum and a second voltage maximum occur respectively at the foresaid ends of the radiator (3), and that the region of the free end (6) of the radiator is capacitively coupled to another point (7) of the radiator such that the further resonant frequency is reduced relative to three times the value of the first resonant frequency when the foresaid capacitive coupling is present. It is advantageous that the entire surface area of the radiator is used in two frequency ranges and that only one single connection point to the radiator is required for the feed line.

20 Claims, 2 Drawing Sheets

INTEGRATED ANTENNA FOR MOBILE TELEPHONES

BACKGROUND OF INVENTION

The invention relates to an antenna arrangement (flat antenna arrangement, plate antenna arrangement, patch antenna arrangement) with an earth plate and with a radiator which is arranged at a distance from and substantially in parallel to the earth plate and at one of its end zones is conductively connected to said earth plate, wherein at a first resonant frequency of the antenna arrangement a voltage minimum occurs at the connection point of the radiator to the earth plate and a first voltage maximum occurs in the region of the other end (free end) of the radiator.

Integrated antennae for mobile telephones based on the principle of the patch antenna are known. In existing applications the outer dimensions of such an antenna module are minimised for example by using a folded structure (e.g. C-patch). In addition to the single-resonance design (one single operating frequency band) other structures are known which facilitate operation in two defined frequency bands (such as for example in the two mobile radio communications bands of the GSM 900 and GSM 1800 standards). Here either two separate radiators are used or suitable measures are employed to provide that at the higher operating frequency only a specific part of the radiator is used. These procedures have the disadvantage that they do not utilize the whole of the available antenna volume, in particular at the higher frequency. As a result, the antenna has a small bandwidth.

The object of the invention is to develop an arrangement of the type referred to in the introduction such that it is suitable for two frequency ranges and permits a broadband construction.

SUMMARY OF THE INVENTION

This object is achieved, in accordance with the a flat antenna arrangement (plate antenna arrangement, patch antenna arrangement) with an earth plate and a radiator which is arranged at a distance from and substantially in parallel to the earth plate and at one of its end zones is conductively connected to said earth plate, wherein at a first (lower) resonant frequency of the antenna arrangement a voltage minimum occurs at the connection point of the radiator to the earth plate and a first voltage maximum occurs in the region of the other end (free end) of the radiator, in that at a further higher resonant frequency a voltage minimum and a second voltage maximum occur respectively at the foresaid ends of the radiator, and that the region of the free end of the radiator is capacitively coupled to another point of the radiator such that the further resonant frequency is reduced relative to three times the value of the first resonant frequency.

An advantage of the invention consists in that the entire radiator emits radiation in both frequency ranges. In this way a relatively large bandwidth is also possible at the higher frequency because a large radiator surface area is available. An advantage also exists at the lower frequency because here too the whole of the surface area available for the antenna can be used as radiator. One single point of the radiator can be used for the feeding.

In an embodiment of the invention, the capacitance value and connection point of the capacitive coupling are selected such that the second resonant frequency at least roughly approximates double the first resonant frequency. The suitability for operation in the 900/1800 MHz or 900/1900 MHz bands is advantageous.

In an embodiment of the invention the capacitance value and the other point are selected such that the first resonant frequency is reduced to a lesser extent than the second resonant frequency. It is advantageous that the dimensions of the antenna can be kept small.

In an embodiment of the invention the foresaid other point of the radiator, at which the capacitive coupling takes place, is situated in the vicinity of the first voltage maximum on the radiator at the second resonant frequency. A particularly large reduction in the second resonant frequency with a small reduction in the first resonant frequency is advantageous.

In an embodiment of the invention the foresaid other point is situated at approximately ⅓ of the unwound length of the radiator, measured from the connection to the earth plate. This dimensioning is favourable in many cases.

In an embodiment of the invention, the radiator at least partially has the approximate shape of a C, including an approximately C-shaped, non-circular, angular formation. This has proved favourable.

In an embodiment of the invention, the form of the radiator is selected such that the free end of the radiator is adjacent to a point of the radiator which corresponds to the desired other connection point of the capacitance. The short connection lines for the capacitor which are thereby facilitated are advantageous.

In an embodiment of the invention, the capacitive coupling is formed by a metal strip which, with an interposed layer of dielectric material, covers a part of the length of the free end zone and a part of the radiator at the other point provided for the capacitive coupling, such that the capacitive coupling is formed by a serial connection of two capacitors. The simple and space-saving construction is advantageous.

The invention also relates to a hand-held radiocommunications device, including transceivers, for at least one of the purposes: speech transmission, data transmission, video transmission, with an antenna, characterised by the fact that the antenna is formed by the antenna arrangement according to one of the claims substantially described above. It is advantageous that a simple transmitting/receiving circuit is possible. It is also possible for the device to possess a small structural form.

The invention also relates to a use of an antenna arrangement and a design of a hand-held radiocommunications device as referred to above. In accordance with the invention, only the second (higher) resonant frequency of the antenna arrangement is used in operation. This can lead to stockkeeping advantages if only the higher frequency band is required, but two-band antennas according to the invention are available.

DESCRIPTION OF THE INVENTION

Further features and advantages of the invention will be described in the following description of exemplary embodiments of the invention making reference to the drawing, which illustrates essential details of the invention, and in the claims. The individual features can be implemented either individually or jointly in any combination in an embodiment of the invention. In the drawings:

Figure 5:
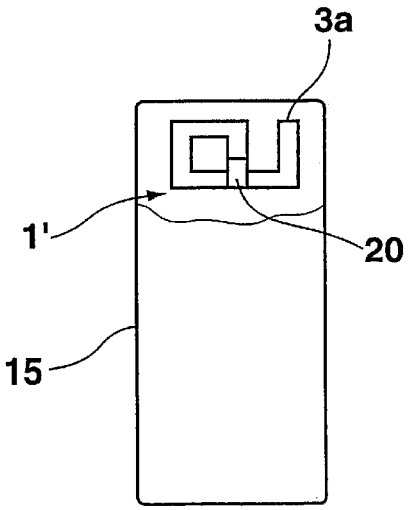
FIG. 5 is a view of a hand-held mobile telephone device with antenna.
Figure 5A:
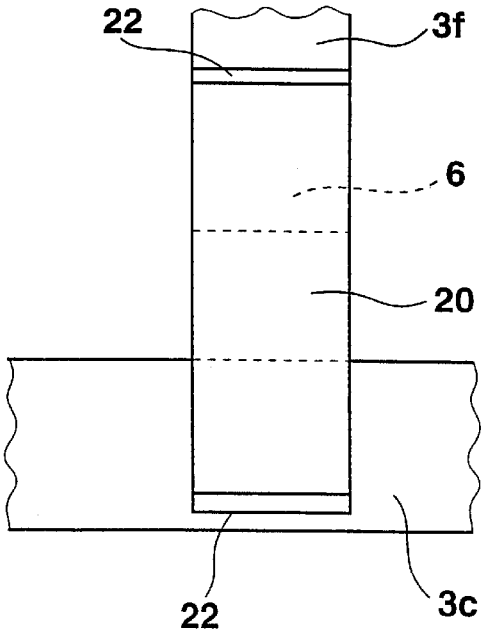

FIG. 5*a* illustrates a detail 20 of FIG. 5 on an enlarged scale.

Figure 1:
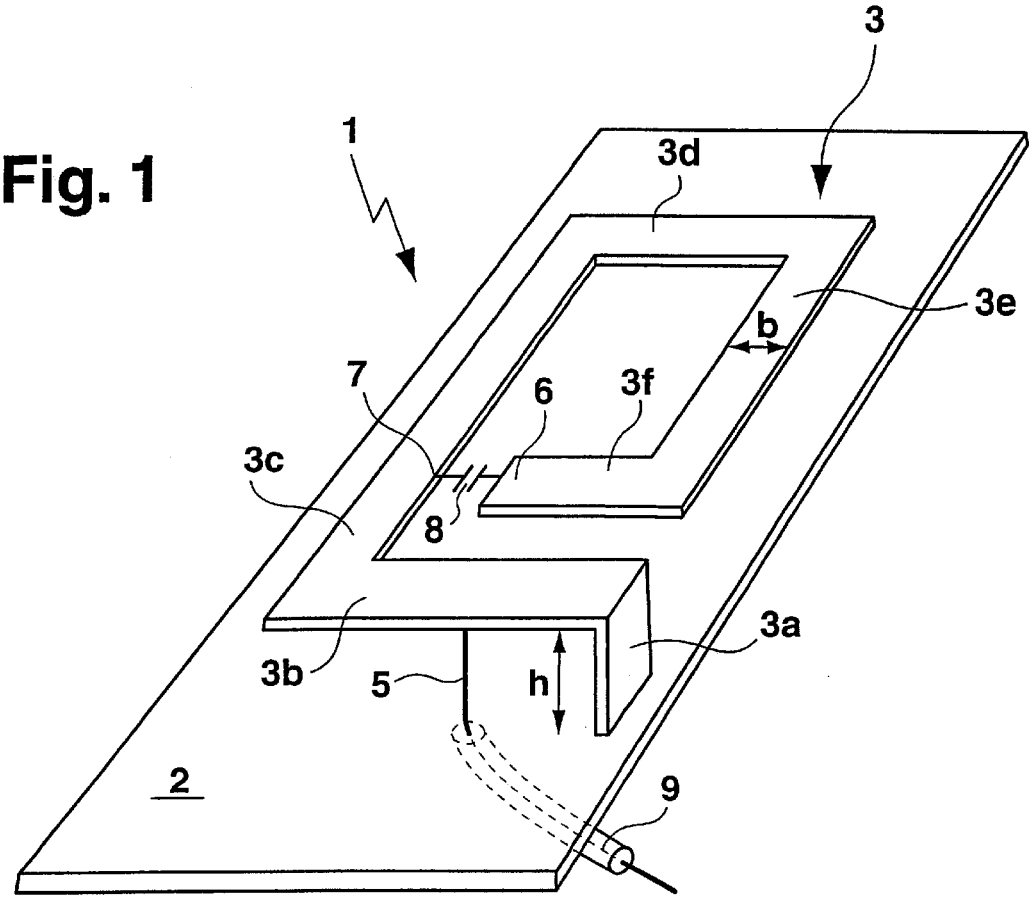
FIG. 1 is a schematic perspective view of an exemplary embodiment of an antenna.

In FIG. 1 the antenna arrangement 1 comprises an earth plate 2. In the example this is flat. At a distance from the earth plate 2, along the greater part of its length a radiator 3 extends in parallel to the earth plate 2 and is maintained at a constant distance from the earth plate 2 by suitable means (not shown). In a first exemplary embodiment illustrated in FIG. 1 these means comprise a few spacers made of insulating material arranged between the radiator 3 and the earth plate 2. In another exemplary embodiment the foresaid means comprise a plate made of dielectric material arranged between the radiator 3 and the earth plate 2. The overall construction of the radiator 3 is multi-angular. One end of the part of the radiator 3 extending in parallel to the earth plate 2 is conductively connected to the earth plate 2 over its entire width by a section 3*a* (short-circuit plate) extending at right angles to the earth plate 2. The section 3*a* is adjoined by a section 3*b* of the radiator 3 which in turn is adjoined at right angles by a section 3*c* extending in parallel to a longitudinal edge of the earth plate 2, which in the example is rectangular, said section 3*c* being adjoined by a section 3*d* extending in parallel to the section 3*b*, and the section 3*d* being adjoined by a section 3*e* at a distance from the section 3*c* and extending in parallel thereto. The sections 3*b* to 3*d* together have the approximate shape of a letter C. In the exemplary embodiment, at the end of the section 3*e* situated close to the short-circuit plate 3*a* there is also arranged a further section 3*f* which lies much closer to the section 3*b* than to the section 3*d* and extends into the vicinity of the section 3*c*.These sections 3*b* to 3*f* form a flat, angular, spiral-like arrangement. The illustrated antenna can also be referred to as flat antenna, plate antenna or patch antenna.

In an embodiment of the invention, the entire radiator 3 comprising the foresaid sections 3*a* to 3*f* is produced in one piece from a thin metal sheet by punching and bending. In another embodiment, the radiator is applied as a metallization to the upper face and one edge face of the above mentioned insulating plate made of dielectric material.

In the case of transmission and reception, the feeding of the radiator 3 takes place via a feed line 5 which is arranged at a distance from the short-circuit plate 3*a* and is connected to the radiator 3 (in the example to the section 3*b*), the distance being selected such that a desired characteristic impedance is obtained for the feeding. As a relatively small characteristic impedance is generally desired (order of magnitude 50 Ohm), compared to the overall unwound length of the radiator 3 the feed line 5 lies relatively close to the short-circuit plate 3*a*.A capacitor 8 is connected on the one hand to the end zone 6 facing away from the short-circuit plate 3*a*,in the example exactly at the free end of the radiator 3 or to be more precise the section 3*f* thereof, and on the other hand to a point 7 of the section 3*c* which in the exemplary embodiment is situated exactly opposite.

The height h corresponding to the length of the short-circuit plate 3*a*,at which the majority of the radiator 3 is arranged above the earth plate 2, is small compared to one quarter of the wavelength of the high frequency at which the antenna arrangement 1 is to be operated.

The above mentioned low-ohmic feeding of the feed line 5 has been symbolised in FIG. 1 by a coaxial cable 9 extending from below to the earth plate 2. The outer conductor of the coaxial cable 9 is connected to the conductive, visible surface of the earth plate 2 and the central conductor of the coaxial cable 9 is connected to the feed line 5.

In a practical application the coaxial cable 9 will often be very much shorter than shown, or possibly the coaxial cable can be entirely omitted because, in embodiments of the invention, the electronic circuit to be connected to the antenna arrangement 1 is arranged directly beneath the earth plate 2. In other embodiments of the invention the earth plate 2 is formed by the substantially continuous metallization of a printed circuit board, on the underneath of which the circuit components of a printed circuit are arranged.

Figure 2:
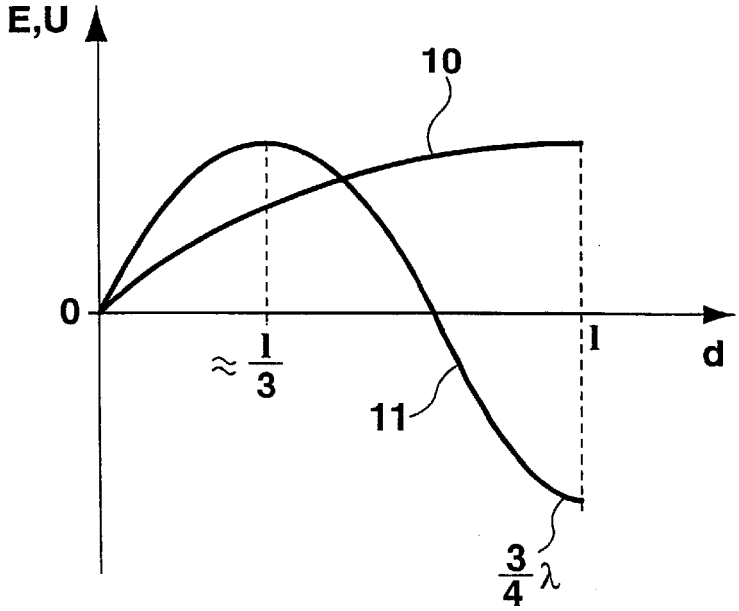
FIG. 2 is a graphic diagram of the voltage distribution along the length of an antenna according to FIG. 1, but with no capacitor, at two resonant frequencies.

In explanation of the mode of functioning of the antenna arrangement shown in FIG. 1, reference will firstly be made to FIG. 2 which is based on an antenna according to FIG. 1 but with no capacitor. The distance d from the connection point of the short-circuit plate to the earth plate up to the free end of the radiator 3 is plotted on the horizontal axis, where d=0 at the other end of the short-circuit plate 3*a* (i.e. the connection point to the earth plate 2). The fundamental characteristic curve of the voltage and field strength for the feeding of the antenna arrangement with high frequency at two different frequencies is plotted on the vertical axis.

The curve 10 in FIG. 2 illustrates the voltage characteristic curve for the feeding of the antenna arrangement with no capacitor with the first, lowest resonant frequency of the radiator 3, which occurs when a quarter of the wavelength corresponds to the effective length of the radiator 3 including the short-circuit plate. For simplification, the influence of the dielectric constant of an insulating plate (as spacer or carrier of the radiator) will be omitted from these explanations. When the feed line 5 is fed with this first resonant frequency, the voltage thus possesses a first maximum at the free end of the radiator, corresponding to an unwound length l, and possesses the value 0 at the lower end of the short-circuit plate.

The next higher resonant frequency comes into effect when a maximum occurs again at the end 6 upon an increase in the feed frequency. This is the case when the length l of the radiator 3 corresponds to a value of ¾ of the wavelength of the feeding high frequency. This second-mentioned resonant frequency occurs at a frequency which exceeds the first-mentioned resonant frequency by the factor 3.

An arrangement of this kind (with no capacitor) is unserviceable if it is to be used to provide a portable transmitting-receiving device (transceiver), operating with electromagnetic waves, with an antenna arrangement which is to operate in two frequency ranges differing substantially in their frequency (but not by the factor 3), for example roughly differing in their frequency by the factor 2. Such frequency ranges are standard for so-called GSM mobile telephones, which have a lower frequency range (device standard GSM 900) at roughly 900 MHz, and a next higher frequency range (device standard GSM 1800) at roughly 1800 MHz. When it possesses the features according to FIG. 2, the above mentioned antenna arrangement thus cannot be operated in resonance at both the foresaid frequencies.

However, the embodiment illustrated in FIG. 1 facilitates such dual-band operation.

In practice the above mentioned antenna arrangements have such a narrow band that, even in the case of mobile telephones which operate exclusively in accordance with the GSM 900 standard and in the case of which transmitting and receiving operation take place in bands separated by a frequency gap, for transmission and reception tuning must take place by means of a respective connection provided at the feed point. The present invention is not concerned with this problem and neither is this problem necessarily solved by the invention.

Rather, in accordance with the invention, it is unnecessary to effect a switch-over expressly for changing between two frequency bands (for example, as described, between 900 MHz and 1800 MHz) in the region of the antenna. One single feed line 5 is used for the feeding.

In the arrangement according to FIG. 1, the arrangement is now such that the connection point 7 of the capacitor 8 is situated at approximately one third of the overall unwound length of the radiator 3. As already stated, the other connection point of the capacitor 8 is connected to the free end of the radiator 3. The capacitor 8 is thus connected between two points of the radiator 3 at which, in the case of operation at the low resonant frequency, the voltages (to be read from the curve 10 in FIG. 2) differ by a relatively small amount, and in particular are much lower than half the voltage at the free end of the radiator 3. This relatively low voltage drives a capacitive current through the capacitor 8 and has a relatively small influence, in terms of frequency reduction, upon this lower resonant frequency (curve 10) of the antenna arrangement 1 compared to the state with no capacitor 8.

Conversely, when the antenna arrangement 1 is operated at the higher resonant frequency, without any switch-over measures the capacitor 8 is now situated between two points (the same points 6 and 7 as previously) between which there is a relatively large voltage difference, which is much greater than the voltage at the free end of the radiator 3. The eye can readily detect from FIG. 2 that the capacitor 8 is connected to a voltage which is double the voltage at the free end of the radiator 3. Thus the influence of the capacitor 8 in terms of frequency reduction or antenna lengthening is very much greater at the higher resonant frequency than at the lower resonant frequency.

As the lower resonant frequency is also influenced somewhat in terms of antenna lengthening (frequency reduction), the length 1 will be made slightly shorter compared to the state with no capacitor, so that the slight frequency reduction of the lower resonant frequency then leads to the desired resonant frequency, in the example the resonant frequency in the GSM 900 range.

As already stated, the higher resonant frequency is reduced to a very much greater extent so that, when the magnitude of the capacitor 8 is suitably selected, this higher resonant frequency has the value required for GSM 1800.

The general theory relating to the connection point of the capacitor 8 is that the capacitor is to be connected to the radiator such that it influences (i.e. reduces) the higher resonant frequency to a greater extent than the lower resonant frequency. More specifically, the theory is that the connection point of the capacitor is such that the voltage occurring at the connection point is greater at the higher resonant frequency than at the lower resonant frequency. In the specific example the capacitor 8 is connected approximately at the location at which the two phase-opposed maxima of the voltage curve occur at the second resonant frequency.

It should be noted that at the present time another GSM standard exists which operates at an even higher frequency of approximately 1900 MHz (GSM 1900). This frequency also falls into the range of the substantially differing, in particular roughly double, frequency of the first resonant frequency and thus can likewise be implemented by the invention.

The frequency ranges are approximately 880 to 960 MHz for GSM 900, approximately 1710 to 1880 MHz for GSM 1800 and approximately 1850 to 1990 MHz for GSM 1900.

Figure 3:
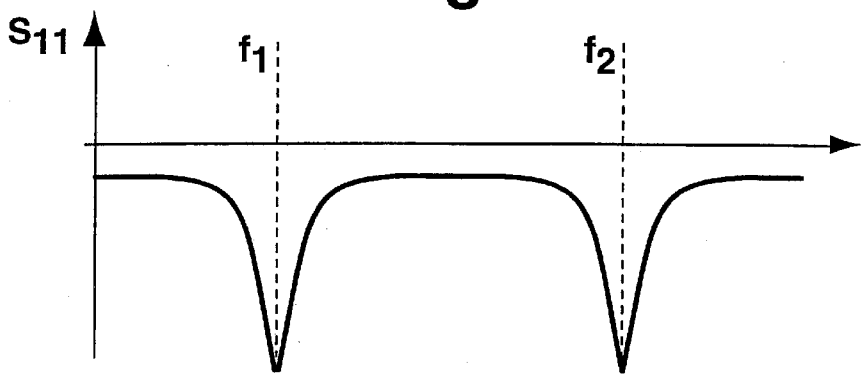
FIG. 3 illustrates the position of two resonant frequencies of the antenna according to FIG. 1 without the presence of the capacitor according to FIG. 1.
Figure 4:
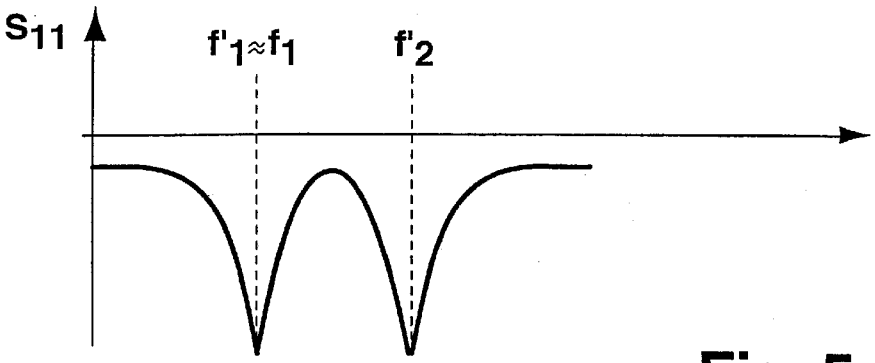
FIG. 4 illustrates, on the same frequency scale as FIG. 3, the altered position of the resonant frequencies compared to FIG. 3 as a result of the presence of the capacitor according to FIG. 1.

The position of the resonant frequencies without the presence of the capacitor 8 is illustrated in FIG. 3. $s_{11}$ is the reflection factor measured at the feed-in point. At the resonant frequencies f1 and f2 the reflection factor is considerably smaller than at other frequencies, because at these resonant frequencies the antenna radiates a large part of the fed-in high-frequency power. The frequency f2 is three times the value of the frequency f1. FIG. 4 illustrates the state which exists when the capacitor 8 is present. The frequency P1 has only slightly reduced compared to f1 and therefore has the approximate value f1, while the higher resonant frequency P2 has considerably reduced compared to f2 in FIG. 3.

The person skilled in the art will be aware that other influences (the housing of the hand-held radiocommunications device, in particular a GSM mobile telephone, the effect of a hand holding the device and other influences) can give rise to noticeable changes in lengths based on theoretical considerations or on an antenna arrangement operated in an uninstalled state. Therefore fine adaptations may optionally also be required compared to the dimensioning rules for the construction explained here.

In the plan view the five radiator sections 3*b* to 3*f* provided in the arrangement according to FIG. 1 form the approximate shape of a small letter "e". Therefore the name e-patch is proposed for this arrangement.

The antenna arrangement 1 is designed such that it fills a limited available space with the largest possible, high-frequency-conducting radiator surface area. The section 3*f* adjoining the section 3*e* also serves for this purpose, which section 3*f* forms part of the unwound radiator length 1 (which is somewhat smaller than measured along the respective centre lines of the individual sections) and due to its vicinity to the section 3*c* offers a practical connection option for the capacitor 8. At the lower resonant frequency, at which the radiator 3 is a $\lambda/4$ radiator, the radiator 3 radiates along its entire length. However this is also the case at the higher resonant frequency. Here again the radiator 3 radiates with all its sections 3*a* to 3*f*,thus not only with those with a shorter length. This is an important advantage because the antenna arrangement thus has a relatively broad band also at the higher resonant frequency. Conversely, as mentioned above, the antenna may require a switch-over adaptive facility in order to optimally adapt the antenna arrangement to the receiving range of GSM 1800 on the one hand and the transmitting range of GSM 1800 on the other hand. It will be clear that these embodiments should also be used directly when the antenna is dimensioned for GSM 1900 instead of for GSM 1800 or when other standards, such as AMPS, are employed.

In particular, it should be noted that in the case of the exemplary embodiment according to FIG. 1, no essential parts of the surface area of the radiator 3 are lost for the connection of the capacitor 8. The capacitor 8 can be simply connected between the zones 6 and 7.

A preferred embodiment of an antenna arrangement 1' (FIG. 5) is that in which the capacitor 8 is formed by a sheet metal strip 20 whose width corresponds approximately to that of the section 3*f* and which is placed over the gap between the free end 6 and the section 3*c*,with sufficient overlap of the two adjacent sections 3*c* and 3*f*,and with an interposed layer of dielectric material (synthetic resin sheet 22, see FIG. 5*a*) is connected to these parts at a defined distance therefrom. In this way two capacitors are formed which are serially connected to one another via a relatively wide and short, and thus low-induction, connection line.

For the optimal dimensioning of the antenna, in particular the capacitive value of the capacitor 8 and the connection point 7 are variable. For example, it may be useful to connect the capacitor at a point of the section 3*c* for which the value d according to FIG. 2 is somewhat greater than the length ⅓, because with such an increase in the distance from the earth plate only a small change occurs in the voltage occurring across the capacitor at the higher resonant frequency (because the point d=⅓ occurs at the maximum of the curve 11), whereas a greater change occurs in the corresponding voltage of the curve 10 (lower frequency range) so that in this way the influence of the capacitor upon the lower resonant frequency can be further reduced somewhat.

In a simple diagram FIG. 5 shows a partially broken-away, hand-held radiocommunications device 15, namely a mobile telephone, containing the above described antenna arrangement 1' as antenna. In the case of this antenna the capacitor is formed by a sheet metal strip 20, positioned over the parts 3*c* and 3*f* with an interposed insulating layer, as serial connection of two capacitances. The short-circuit plate 3*a* is arranged towards the upper end of the housing of the mobile telephone. In the example the hand-held radiocommunications device is designed for the GSM 900 and GSM 1800 ranges. The antenna arrangement is fully accommodated inside the housing of the mobile telephone and thus forms an integrated antenna.

In a special exemplary embodiment of the antenna arrangement according to FIG. 1 for a mobile telephone for the GSM 900 and GSM 1800 ranges, the radiator occupies a space of approximately 5 cm×4 cm×0.5 cm (the latter being the length of the short-circuit plate).

It will be apparent from FIG. 1 that, while retaining the radiator length and the length subdivision of ⅓ to ⅔, by virtue of the connection point 7 of the capacitor and the close vicinity of the zone 6 and the point 7, it is possible to substantially change the shape of the radiator sections without departing from the principle of the invention.

As described, short supply lines to the capacitor 8 result in a small space requirement and relatively small losses. The small space requirement permits dimensioning for the largest possible bandwidth.

It should also be emphasised that the feeding of the antenna arrangement takes place at the same connection point for both frequency bands, namely at the connection point of the feed line 5 to the radiator 3.

If, in the arrangement according to FIG. 1, the higher resonant frequency were to be reduced by omitting the capacitor 8 and connecting a capacitor between the free end of the radiator 3 and earth, this would also result in a considerable reduction in the lower resonant frequency and little change would occur in the frequency ratio of 3:1 between the higher and the lower resonant frequency so that a circuit of this type would be unserviceable.

What is claimed is:

1. A flat antenna arrangement with an earth plate and radiator which is arranged at a distance from and substantially in parallel to the earth plate and at one of its ends is conductively connected to said earth plate, wherein at a first lower resonant frequency of the antenna arrangement a voltage minimum occurs at the connection point of the radiator to the earth plate and a first voltage maximum occurs in the region of the other free end of the radiator, with occurring at a second, higher resonant frequency a voltage minimum and a second voltage maximum respectively at the foresaid respective ends of the radiator, and wherein the region of the free end of the radiator is capacitively coupled to another point of the radiator, reducing the second resonant frequency to smaller than or equal to three times the value of the first resonant frequency when the foresaid capacitive coupling is present.

2. An antenna arrangement according to claim 1, selecting the capacitance value and the connection point of the capacitive coupling such that the second resonant frequency at least approximates twice the first resonant frequency.

3. An antenna arrangement according to claim 1, selecting the capacitance value and the other point such that the first resonant frequency is reduced to a lesser extent than the second resonant frequency.

4. An antenna arrangement according to claim 1, situating the foresaid other point of the radiator, at which the capacitive coupling takes place, in the vicinity of the first voltage maximum on the radiator at the second resonant frequency.

5. An antenna arrangement according to claim 4, situating the foresaid other point at approximately ⅓ of the unwound length of the radiator, measured from the connection point to the earth plate.

6. An antenna arrangement according to claim 1, wherein the radiator at least in part has the approximate shape of a C, including a non-circular, angular, approximately C-shaped form.

7. An antenna arrangement according to claim 1, wherein the form of the radiator is selected such that the free end is adjacent to a point of the radiator which corresponds to said other point of the capacitive coupling.

8. An antenna arrangement according to claim 1, wherein the capacitive coupling is formed by a metal strip which, with an interposed layer of dielectric material, covers a part of the length of the free end and a part of the radiator at the other point provided for the capacitive coupling, such that the capacitive coupling is formed by a serial connection of two capacitors.

9. An antenna arrangement according to claim 1, wherein a feed for the antenna arrangement is provided at the same connection point to the radiator for a plurality of frequency bands.

10. A hand-held radiocommunications device, including transceivers, for at least one of the purposes: speech transmission, data transmission, video transmission, with an antenna, characterised in that the antenna is formed by the antenna arrangement according to claim 1.

11. A use of an antenna arrangement of a hand-held radiocommunications device according to claim 1, wherein only the second resonant frequency of the antenna arrangement is used in operation.

12. A flat antenna arrangement, comprising:

an earth plate, a radiator having a first end and a second end, said radiator spaced from and substantially parallel to said earth plate, said radiator conductively connected at a connection point at the first end to said earth plate; and wherein:

at a first resonant frequency of the antenna arrangement, a first voltage minimum occurs at the connection point of the radiator to the earth plate and a first voltage maximum occurs at the second end of the radiator; and at a second resonant frequency of the antenna arrangement that is higher than the first resonant frequency, a second voltage minimum occurs at the connection point of the radiator to the earth plate and a second voltage maximum occurs at the second end of the radiator;

the flat antenna arrangement further comprising a capacitor coupling the second end of the radiator capacitively to an intermediate part of the radiator between the first end and the second end, said capacitor making the second resonant frequency smaller than three times the first resonant frequency, said capacitor being a distinct structure from said second end of the radiator.

13. The flat antenna arrangement according to claim 12, wherein a single point feed is used to drive the antenna at both the first and second resonant frequencies.

14. The flat antenna arrangement according to claim 12, wherein substantially an entire physical length of the radiator is used to radiate at both the first and second resonant frequencies.

15. The flat antenna arrangement according to claim 12, wherein the second resonant frequency is approximately two times the first resonant frequency.

16. The flat antenna arrangement according to claim 12, wherein a voltage occurring across the capacitor is greater at the higher resonant frequency than at the lower resonant frequency so that the frequency reduction due to the capacitor is greater at the second resonant frequency than at the first resonant frequency.

17. The flat antenna arrangement according to claim 16, further having two phased-opposed maximum voltages at the second frequency, and wherein the capacitor is connected approximately at a location at which the two phased-opposed maximum voltages occur.

18. The flat antenna arrangement according to claim 12, wherein the first frequency is between approximately 880–960 MHz.

19. The flat antenna arrangement according to claim 18, wherein the second frequency is between approximately 1710 to 1880 MHz.

20. The flat antenna arrangement according to claim 18, wherein the second frequency is between approximately 1850 to 1990 MHz.

* * * * *